US010814634B1

(12) United States Patent
Rosdahl, Jr. et al.

(10) Patent No.: US 10,814,634 B1
(45) Date of Patent: Oct. 27, 2020

(54) PRINTHEAD CAP FOR ATTENUATING THE DRYING OF INK FROM A PRINTHEAD DURING PERIODS OF PRINTER INACTIVITY

(71) Applicant: Xerox Corporation, Norwalk, CT (US)

(72) Inventors: Robert E. Rosdahl, Jr., Ontario, NY (US); Paul S. Bonino, Ontario, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 16/508,563

(22) Filed: Jul. 11, 2019

(51) Int. Cl.
*B41J 2/165* (2006.01)
*B41J 29/38* (2006.01)
*B41J 2/17* (2006.01)

(52) U.S. Cl.
CPC ..... *B41J 2/16511* (2013.01); *B41J 2/16523* (2013.01); *B41J 2/1707* (2013.01); *B41J 29/38* (2013.01)

(58) Field of Classification Search
CPC .. B41J 2/16511; B41J 2/1707; B41J 2/16523; B41J 29/38
USPC ..... 347/32
See application file for complete search history.

(56) References Cited

U.S. PATENT DOCUMENTS

2003/0025755 A1 2/2003 Baxter et al.
2004/0104961 A1 6/2004 Hashi et al.
2004/0160472 A1 8/2004 Khalid et al.
2004/0189739 A1 9/2004 Okamoto
2008/0088666 A1* 4/2008 Shindo ..... B41J 2/16508 347/30
2008/0218554 A1 9/2008 Inoue
2009/0141073 A1 6/2009 Umeda
2011/0090280 A1 4/2011 Hibbard et al.
2011/0279535 A1 11/2011 Love et al.
2012/0320126 A1 12/2012 Martin et al.
2013/0038662 A1 2/2013 Karppinen et al.
2016/0243832 A1* 8/2016 Kobayashi ..... B41J 2/16508
2017/0297339 A1 10/2017 Midorikawa

* cited by examiner

*Primary Examiner* — Huan H Tran
*Assistant Examiner* — Alexander D Shenderov
(74) *Attorney, Agent, or Firm* — Maginot, Moore & Beck LLP

(57) ABSTRACT

A capping station is configured for storing a printhead during printer inactivity to preserve the operational status of the nozzles in the printhead. Each capping station has a housing having at least one wall and a floor configured to enclose a volume partially, and a plate having a textured surface that is positioned at a predetermined distance from a top surface of the at least one wall of the housing. The textured surface is made of a resilient material that has cells that contain flushing fluid. A printhead is pushed within the volume of the housing to engage the textured surface of the plate to press the flushing fluid into the faceplate of the printhead. The flushing fluid and the proximity of the textured surface keep ink on the faceplate and within the nozzles of the faceplate from drying.

14 Claims, 6 Drawing Sheets

PRINTHEAD CAP FOR ATTENUATING THE DRYING OF INK FROM A PRINTHEAD DURING PERIODS OF PRINTER INACTIVITY

TECHNICAL FIELD

This disclosure relates generally to devices that produce ink images on media, and more particularly, to devices that eject fast-drying ink from inkjets to form ink images.

BACKGROUND

Inkjet imaging devices eject liquid ink from printheads to form images on an image receiving surface. The printheads include a plurality of inkjets that are arranged in some type of array. Each inkjet has a thermal or piezoelectric actuator that is coupled to a printhead controller. The printhead controller generates firing signals that correspond to digital data for images. Actuators in the printheads respond to the firing signals by expanding into an ink chamber to eject ink drops onto an image receiving member and form an ink image that corresponds to the digital image used to generate the firing signals.

A prior art ink delivery system 20 used in inkjet imaging devices is shown in FIG. 4. The ink delivery system 20 includes an ink supply reservoir 604 that is connected to a printhead 608 and is positioned below the printhead so the ink level can be maintained at a predetermined distance D below the printhead to provide an adequate back pressure on the ink in the printhead. This back pressure helps ensure good ink drop ejecting performance. The ink reservoir is operatively connected to a source of ink (not shown) that keeps the ink at a level that maintains the distance D. The printhead 608 has a manifold that stores ink until an inkjet pulls ink from the manifold. The capacity of the printhead manifold is typically five times the capacity of all of the inkjets. The inlet of the manifold is connected to the ink reservoir 604 through a conduit 618 and a conduit 634 connects the outlet of the manifold to a waste ink tank 638. A valve 642 is installed in the conduit 634 to block the conduit 634 selectively. A valve 612 is also provided in the conduit 614 to connect an air pressure pump 616 to the ink reservoir 604 and this valve remains open to atmospheric pressure except during purging operations.

When a new printhead is installed or its manifold needs to be flushed to remove air in the conduit 618, a manifold purge is performed. In a manifold purge, the controller 80 operates the valve 642 to enable fluid to flow from the manifold outlet to the waste ink tank 638, activates the air pressure pump 616, and operates the valve 612 to close the ink reservoir to atmospheric pressure so pump 616 can pressurize the ink in the ink reservoir 604. The pressurized ink flows through conduit 618 to the manifold inlet of printhead 608. Because valve 642 is also opened, the pneumatic impedance to fluid flow from the manifold to the inkjets is greater than the pneumatic impedance through the manifold. Thus, ink flows from the manifold outlet to the waste tank. The pressure pump 616 is operated at a predetermined pressure for a predetermined period of time to push a volume of ink through the conduit 618 and the manifold of the printhead 608 that is sufficient to fill the conduit 618, the manifold in the printhead 608, and the conduit 634 without completely exhausting the supply of ink in the reservoir. The controller then operates the valve 642 to close the conduit 634 and operates the valve 612 to vent the ink reservoir to atmospheric pressure. Thus, a manifold purge fills the conduit 618 from the ink reservoir to the printhead, the manifold, and the conduit 634 so the manifold and the ink delivery system are primed since no air is present in the conduits or the printhead. The ink reservoir is then resupplied to bring the height of the ink to a level where the distance between the level in the reservoir and the printhead inkjets is D as previously noted.

To prime the inkjets in the printhead 608 following a manifold prime, the controller 80 closes the valve 612 and activates the air pressure pump 616 to pressurize the head space of the reservoir 604 to send ink to the printhead. Because the valve 642 is closed, the pneumatic impedance of the primed system through the manifold is greater than the pneumatic impedance through the inkjets so ink is urged into the inkjets. Again, the purge pressure is exerted at a predetermined pressure for a predetermined period of time to urge a volume of ink into the printhead that is adequate to fill the inkjets. Any ink previously in the inkjets is emitted from the nozzles in the faceplate 624 of the printhead 608. This ink purging primes the inkjets and can also help restore clogged and inoperative inkjets to their operational status. After the exertion of the pressure, the controller 80 operates the valve 612 to open and release pressure from the ink reservoir. A pressure sensor 620 is also operatively connected to the pressure supply conduit 622 and this sensor generates a signal indicative of the pressure in the reservoir. This signal is provided to the controller 80 for regulating the operation of the air pressure pump. If the pressure in the reservoir during purging exceeds a predetermined threshold, then the controller 80 operates the valve 612 to release pressure. If the pressure in the reservoir drops below a predetermined threshold during purging, then the controller 80 operates the pressure source 616 to raise the pressure. The two predetermined thresholds are different so the controller can keep the pressure in the reservoir in a predetermined range during purging rather than at one particular pressure.

Some inkjet imaging devices use inks that change from a low viscosity state to a high viscosity state relatively quickly. In a prior art printer, a capping station, such as the station 60 shown in FIG. 5A and FIG. 5B, is used to cover a printhead when the printer is not in use. The cap is formed as a receptacle 704 to collect ink produced by the printhead 708 during a purge of the printhead. An actuator (not shown) is operated to move the printhead 708 into contact with an opening in the receptacle 704 as shown in FIG. 5B so the printhead can be purged to restore inkjets in the printhead by applying pressure to the ink manifold and passageways in the printhead. This pressure urges ink out of the nozzles in the faceplate of the printhead. This ink purging helps restore clogged and inoperative inkjets to their operational status, although the amount of lost ink can be significant. The ink purged from the printhead is directed to an exit chute 712 so the ink can reach a waste receptacle. The cap receptacle 704 also helps keep the ink in the nozzles from drying out because the printhead face is held within the enclosed space of the cap receptacle rather than being exposed to circulating ambient air. For lengthy periods of printer inactivity, for example printing operation shutdowns, the air within the cap receptacle is sufficient to enable some inks to evaporate and dry on the faceplate or in the nozzles. Being able to improve the ability of the capping station to preserve the operational status of the inkjets during a period of printhead inactivity would be beneficial.

SUMMARY

A capping station is configured to reduce the drying of ink on the seals of the capping station and includes structure to preserve the operational status of the inkjets more effectively. The capping station includes a housing having at least one wall and a floor configured to enclose a volume partially, and a plate having a textured surface that is positioned at a predetermined distance from a top surface of the at least one wall of the housing. The textured surface is made of a resilient material that has cells for containment of a flushing fluid.

An inkjet printer includes the capping station configured to reduce the drying of ink on the seals of the capping station and includes structure to preserve the operational status of the inkjets more effectively. The inkjet printer includes a plurality of printheads, and a capping station for each printhead in the plurality of printheads, each capping station includes a housing having at least one wall and a floor configured to enclose a volume partially and a plate having a textured surface that is positioned at a predetermined distance from a top surface of the at least one wall of the housing. The textured surface is made of a resilient material that has cells for containment of a flushing fluid.

BRIEF DESCRIPTION OF THE DRAWINGS

The foregoing aspects and other features of a capping station and printer having a capping station that preserves the operational status of the inkjets more effectively are explained in the following description, taken in connection with the accompanying drawings.

DETAILED DESCRIPTION

Figure 1A:
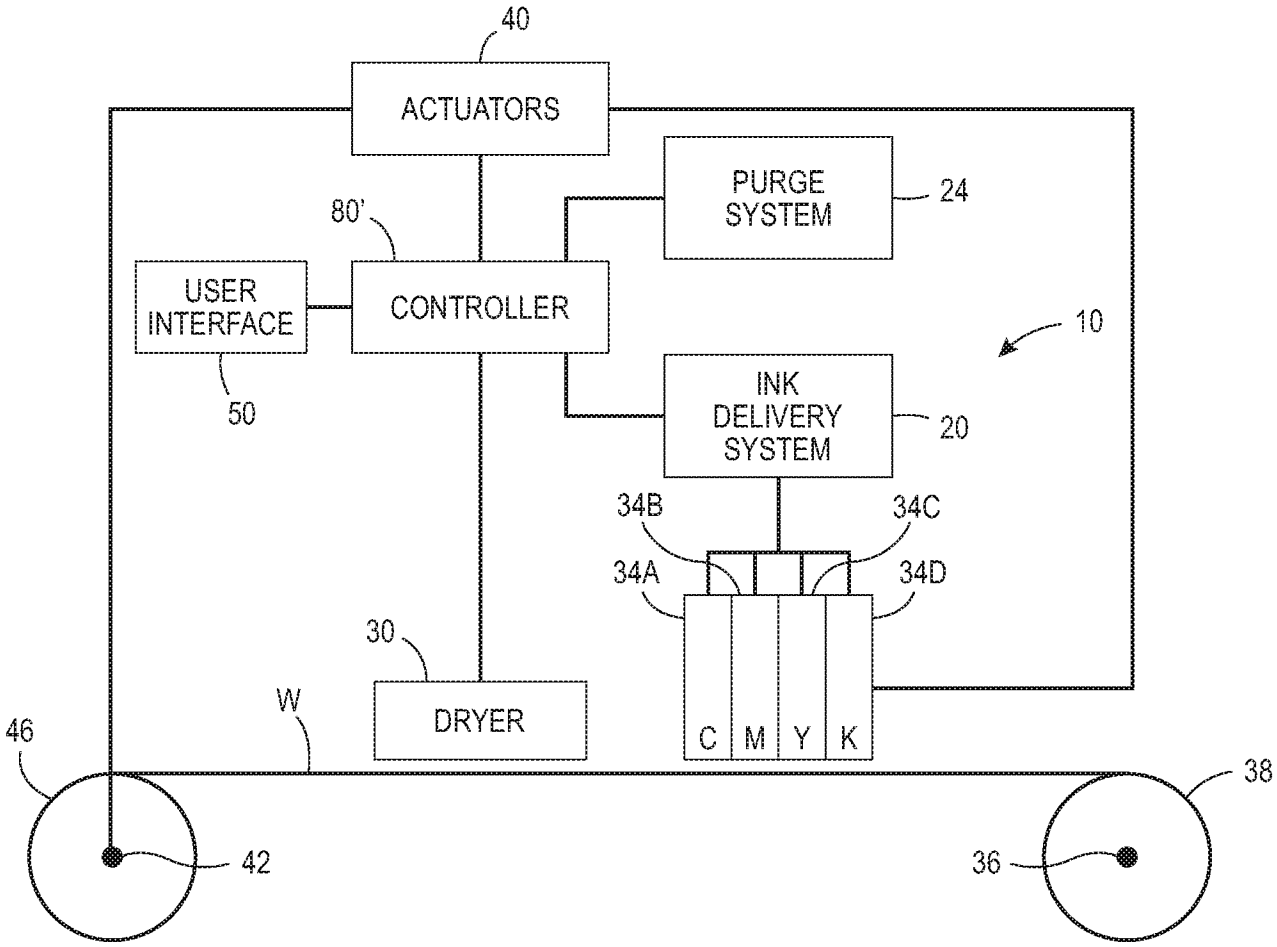
FIG. 1A is a schematic drawing of an inkjet printer that prints ink images directly to a web of media and that caps the printheads to attenuate evaporation of inks from the printheads of the printer and FIG. 1B is a side view showing the positions of the printhead array and capping stations during printing operations.

For a general understanding of the environment for the printer and capping station disclosed herein as well as the details for the printer and capping station, reference is made to the drawings. In the drawings, like reference numerals have been used throughout to designate like elements. As used herein, the word "printer" encompasses any apparatus that produces ink images on media, such as a digital copier, bookmaking machine, facsimile machine, a multi-function machine, or the like. As used herein, the term "process direction" refers to a direction of travel of an image receiving surface, such as an imaging drum or print media, and the term "cross-process direction" is a direction that is substantially perpendicular to the process direction along the surface of the image receiving surface. Also, the description presented below is directed to a system for preserving the operational status of inkjets in an inkjet printer during periods of printer inactivity. The reader should also appreciate that the principles set forth in this description are applicable to similar imaging devices that generate images with pixels of marking material.

FIG. 1A illustrates a high-speed aqueous ink image producing machine or printer 10 in which a controller 80' has been configured to perform the process 300 described below to operate the capping system 60' (FIG. 1B) so the ink at the nozzles of the printheads 34A, 34B, 34C, and 34D maintain a low viscosity state during periods of printhead inactivity. As illustrated, the printer 10 is a printer that directly forms an ink image on a surface of a web W of media pulled through the printer 10 by the controller 80' operating one of the actuators 40 that is operatively connected to the shaft 42 to rotate the shaft and the take up roll 46 mounted about the shaft. In one embodiment, each printhead module has only one printhead that has a width that corresponds to a width of the widest media in the cross-process direction that can be printed by the printer. In other embodiments, the printhead modules have a plurality of printheads with each printhead having a width that is less than a width of the widest media in the cross-process direction that the printer can print. In these modules, the printheads are arranged in an array of staggered printheads that enables media wider than a single printhead to be printed. Additionally, the printheads can also be interlaced so the density of the drops ejected by the printheads in the cross-process direction can be greater than the smallest spacing between the inkjets in a printhead in the cross-process direction. Printer 10 can also be a printer that has a media transport system that replaces the moving web W to carry cut media sheets past the printheads for the printing of images on the sheets.

Figure 4:
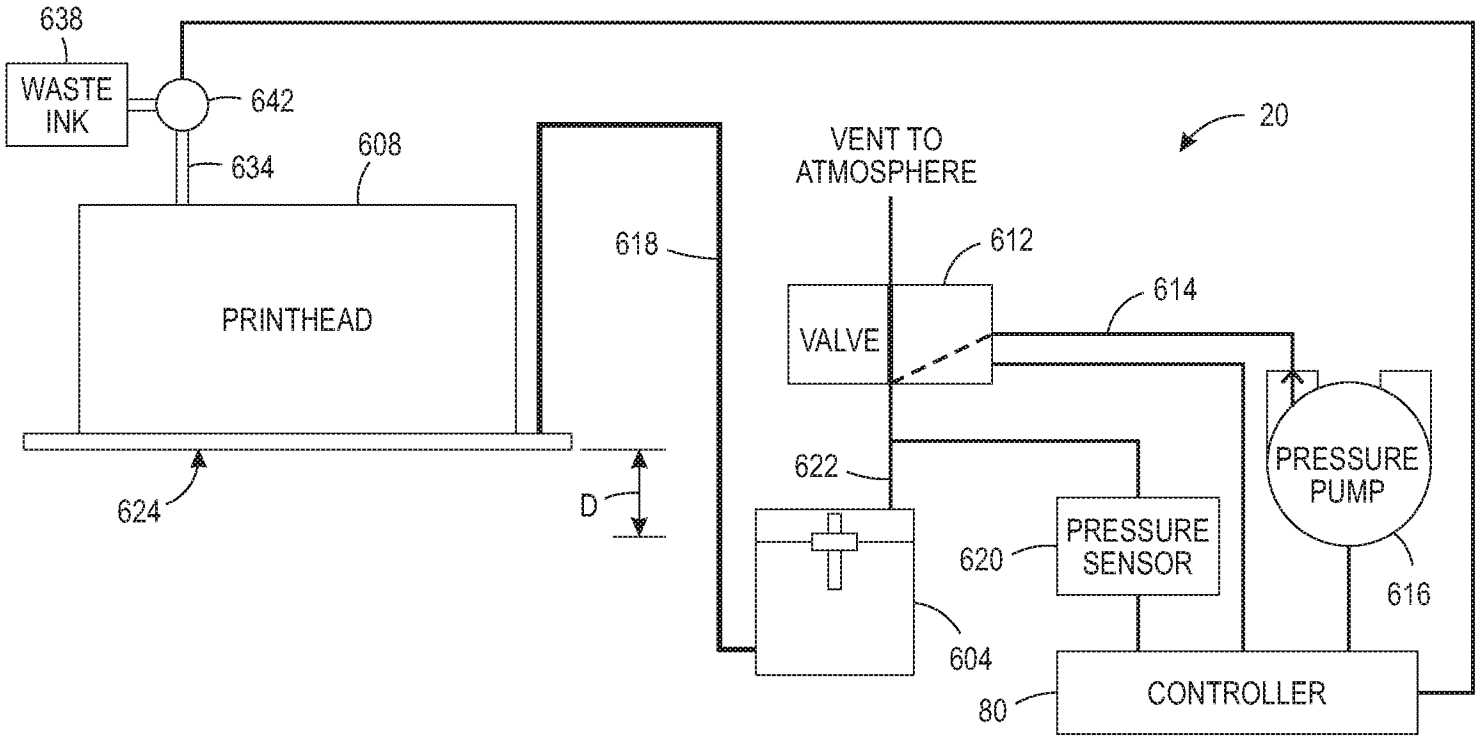
FIG. 4 PRIOR ART
FIG. 4 is a schematic diagram of a prior art ink delivery system that is used in prior art printers for purging only.
Figure 5A:
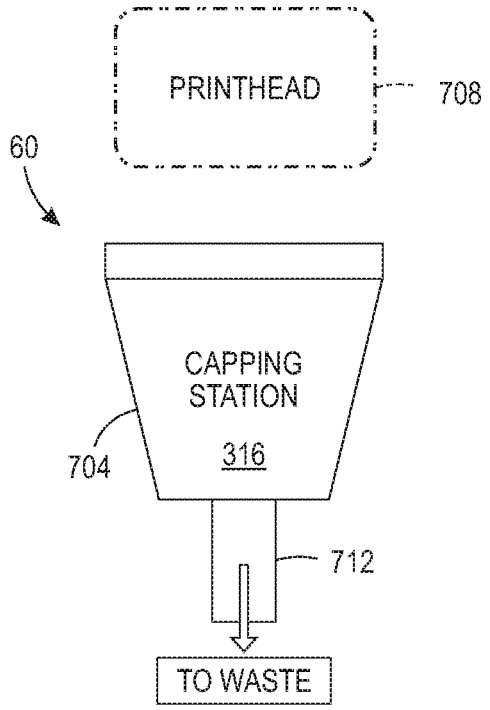
FIG. 5A PRIOR ART
FIG. 5A and FIG. 5B are schematic diagrams of a prior art capping station.
Figure 5B:
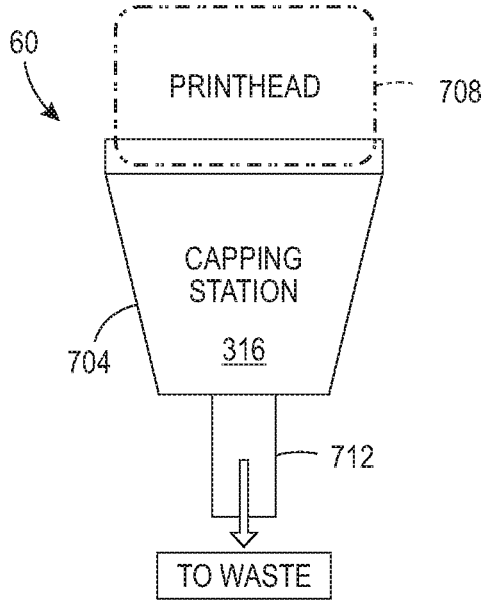
FIG. 5B PRIOR ART

The aqueous ink delivery subsystem 20, such as the one shown in FIG. 4, has at least one ink reservoir containing one color of aqueous ink. Since the illustrated printer 10 is a multicolor image producing machine, the ink delivery system 20 includes four (4) ink reservoirs, representing four (4) different colors CYMK (cyan, yellow, magenta, black) of aqueous inks. Each ink reservoir is connected to the printhead or printheads in a printhead module to supply ink to the printheads in the module. Pressure sources and vents of the purge system 24 are also operatively connected between the ink reservoirs and the printheads within the printhead modules, as described above, to perform manifold and inkjet purges. Additionally, although not shown in FIG. 1A, each printhead in a printhead module is connected to a corresponding waste ink tank with a valve as described previously with reference to FIG. 4 to enable the collection of purged ink during the manifold and inkjet purge operations previously described. The printhead modules 34A-34D can include associated electronics for operation of the one or more printheads by the controller 80' although those connections are not shown to simplify the figure. Although the printer 10 includes four printhead modules 34A-34D, each of which has two arrays of printheads, alternative configurations include a different number of printhead modules or arrays within a module. The controller 80' also operates the capping system 60' and one or more actuators 40 that are operatively connected to the printhead modules 34A, 34B, 34C, and 34D and a flushing fluid applicator 290 (FIG. 1B) to preserve the low viscosity of the ink in the nozzles of the printheads in the printhead modules as described more fully below.

After an ink image is printed on the web W, the image passes under an image dryer 30. The image dryer 30 can include an infrared heater, a heated air blower, air returns, or combinations of these components to heat the ink image and at least partially fix an image to the web. An infrared heater applies infrared heat to the printed image on the surface of the web to evaporate water or solvent in the ink. The heated air blower directs heated air over the ink to supplement the evaporation of the water or solvent from the ink. The air is then collected and evacuated by air returns to reduce the interference of the air flow with other components in the printer.

As further shown, the media web W is unwound from a roll of media 38 as needed by the controller 80' operating one or more actuators 40 to rotate the shaft 42 on which the take up roll 46 is placed to pull the web from the media roll 38 as it rotates with the shaft 36. When the web is completely printed, the take-up roll can be removed from the shaft 42. Alternatively, the printed web can be directed to other processing stations (not shown) that perform tasks such as cutting, collating, binding, and stapling the media.

Operation and control of the various subsystems, components, and functions of the machine or printer 10 are performed with the aid of a controller or electronic subsystem (ESS) 80'. The ESS or controller 80' is operably connected to the components of the ink delivery system 20, the purge system 24, the printhead modules 34A-34D (and thus the printheads), the actuators 40, the heater 30, and the capping station 60'. The ESS or controller 80', for example, is a self-contained, dedicated mini-computer having a central processor unit (CPU) with electronic data storage, and a display or user interface (UI) 50. The ESS or controller 80', for example, includes a sensor input and control circuit as well as a pixel placement and control circuit. In addition, the CPU reads, captures, prepares and manages the image data flow between image input sources, such as a scanning system or an online or a work station connection, and the printhead modules 34A-34D. As such, the ESS or controller 80' is the main multi-tasking processor for operating and controlling all of the other machine subsystems and functions, including the printing process.

The controller 80' can be implemented with general or specialized programmable processors that execute programmed instructions. The instructions and data required to perform the programmed functions can be stored in memory associated with the processors or controllers. The processors, their memories, and interface circuitry configure the controllers to perform the operations described below. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in very large scale integrated (VLSI) circuits. Also, the circuits described herein can be implemented with a combination of processors, ASICs, discrete components, or VLSI circuits.

In operation, image data for an image to be produced are sent to the controller 80' from either a scanning system or an online or work station connection for processing and generation of the printhead control signals output to the printhead modules 34A-34D. Additionally, the controller 80' determines and accepts related subsystem and component controls, for example, from operator inputs via the user interface 50 and executes such controls accordingly. As a result, aqueous ink for appropriate colors are delivered to the printhead modules 34A-34D. Additionally, pixel placement control is exercised relative to the surface of the web to form ink images corresponding to the image data, and the media can be wound on the take-up roll or otherwise processed.

Figure 1B:
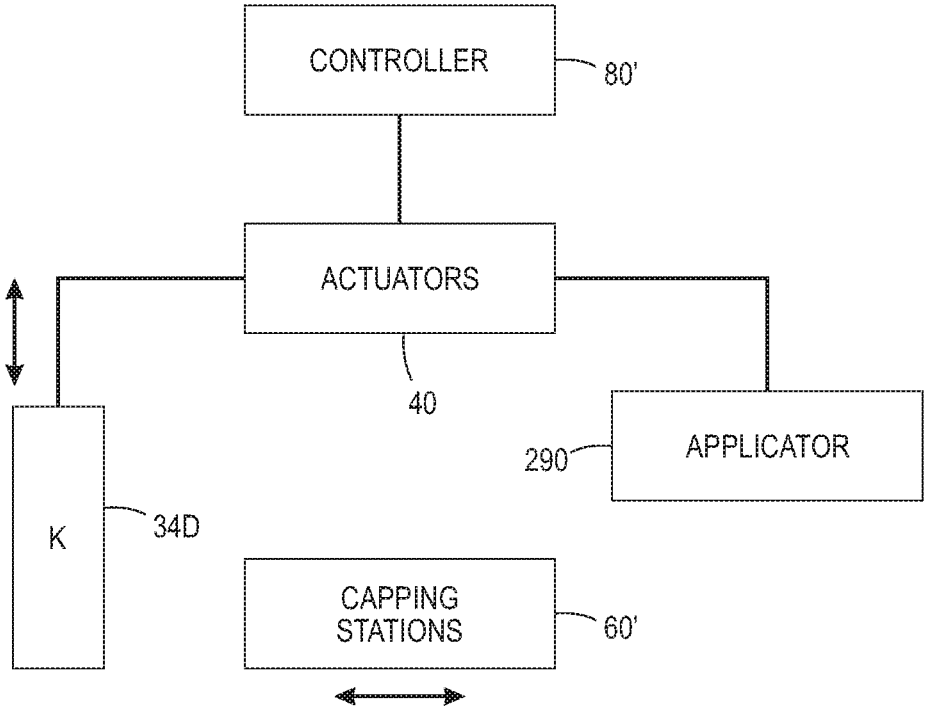

As shown in FIG. 1B, a plurality of capping stations 60' are positioned behind the printhead modules 34A, 34B, 34C, and 34D during printing operations. When one or more printheads need long term storage, the corresponding printhead is raised by the controller 80' operating one of the actuators 40 and is moved to a position opposite the corresponding capping station 60'. The controller 80' then operates the actuators, printhead, and the flushing fluid applicator as described in more detail below to preserve the operational status of the printhead during a period of printhead inactivity. When the printhead is returned to operational status, the controller 80' operates the actuators 40 to lift the printhead from its capping station and return the printhead to its printing position.

Figure 2A:
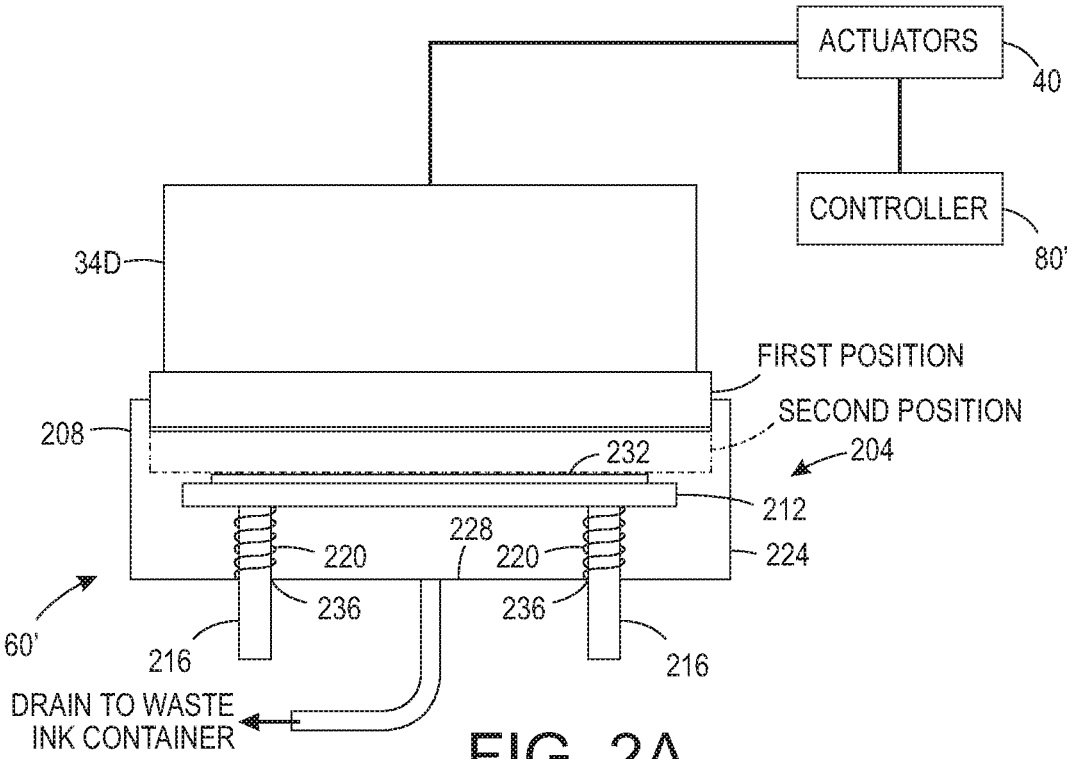
FIG. 2A is a side view of a printhead capping system used in the printer of FIG. 1A and FIG. 1B that helps preserve the operational status of the inkjets during a period of inactivity.

Using like numbers for like components, a capping station that can attenuate the evaporation of quickly drying inks from printheads is shown in FIG. 2A. The capping station 60' includes a housing 204, a sealing member 208, a reciprocating plate 212 having two support members 216 that extend through two openings in the housing 204, and two biasing members 220. The housing 204 has at least one wall 224 and a floor 228 that partially surrounds a volume of air within the housing. The sealing member 208 is mounted along a perimeter of the housing 204 at an upper surface of the wall 224. This seal is made of an elastomeric material that seals the volume within the housing 204 when the controller 80' operates one of the actuators 40 to move one of the printheads in the printhead modules within the perimeter of the sealing member 208 so the sealing member contacts and surrounds the outside perimeter of the nozzle faceplate of the printhead. At this position, which is the first position shown in FIG. 2A, the viscosity of the ink in the inkjets of the printhead is preserved for temporary removal of the printhead from operational service. The duration of the temporary removal is, for example, up to about one hour.

The plate 212 is a planar member having a textured surface 232. The plate 212 has at least two support members 216 that extend from the surface of the plate opposite the textured surface 232. These members are received through two openings 236 in the floor 228 of the housing 204. The members 216 are sized so they slide within seals in the openings 236 without undue friction. A drain 230 is positioned in the floor 228 of the housing 204 so liquids collected in the housing can be directed to a waste receptacle connected to the drain. Interposed between the floor 228 and the surface 232 of the plate 212 from which the members 216 extend are two biasing members 220. The biasing members 220 can be springs or the like mounted about the support members and they operate to maintain the surface 232 against the faceplate of a printhead when the printhead is moved a predetermined distance to the second position shown in FIG. 2A to contact the surface 232. The biasing members 220 have a length so they do not push the surface 232 above the predetermined distance of printhead ingress into the volume of the housing.

Figure 2B:
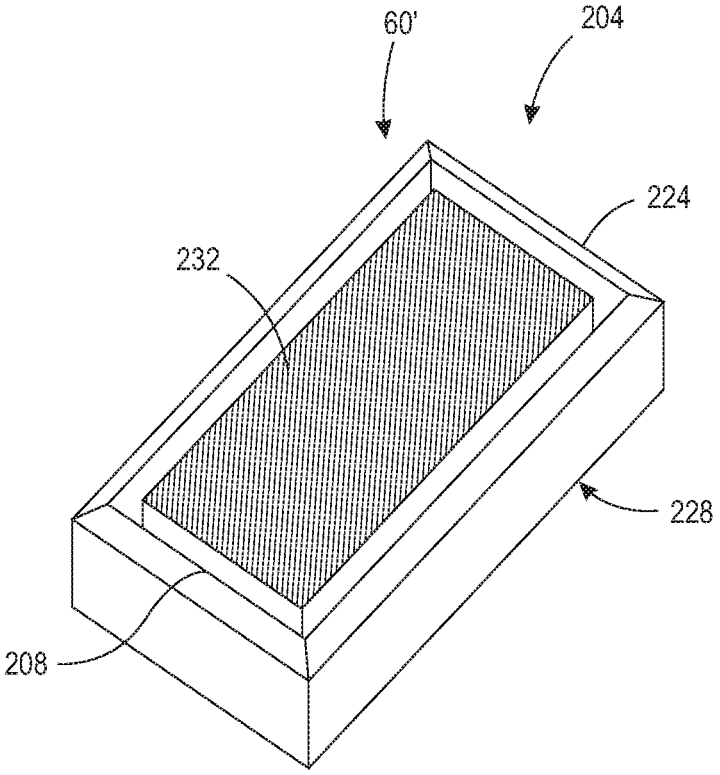
FIG. 2B is an isometric view showing the top of the printhead capping system of FIG. 2A.

FIG. 2B shows the capping station 60' in an isometric view. Looking down into the volume of the housing 204 toward the floor 228, the surface 232 is shown as a textured surface. As used in this document, the term "textured" means an uneven surface with raised walls distributed across the surface to form cells that can contain flushing fluid. The walls have a height in the range of about 5 mm to about 10 mm. The surface is formed with a resilient material, such as molded plastic, that can be deflected when a printhead pushes against the biasing members 220 as the printhead engages the surface 232 so flushing fluid is urged from the cells of the surface onto the faceplate of the printhead. The texture of the surface 232 can be formed with regular or irregular shaped cells. For example, in one embodiment, the textured surface is made of hexagonal cells like a honeycomb, while in other embodiments, the cells are more like those of a sponge. The juxtaposition of the faceplate and the surface 232 keep the flushing fluid immediately adjacent to the nozzles of the inkjets in the faceplate and provides a pressure at the inkjet nozzles that enable the printhead to be filled from an ink source without ink escaping the nozzles of the inkjets. The dimensions of the surface 232 are selected so the area of the surface 232 covers the nozzle array in the printhead faceplate completely yet remain within the perimeter of the faceplate.

Again, with reference to FIG. 1B, a flushing fluid applicator 290 is shown operatively connected to one of the actuators 40. The actuator is configured to move the applicator 290 into the volume within the housing 204 and apply flushing fluid to the surface 232 on the plate 212. As used in this document, "flushing fluid" means any fluid capable of dissolving ink ejected from the printheads of a printer. One example of a flushing fluid that can be used in the capping station is a commercial cleaning fluid formulated for inkjet printers and another is distilled water. The controller 80' is operatively connected to the actuator and is configured to operate the actuator selectively to move the applicator to the housing 204 for the application of flushing fluid to the surface 232 and to return the applicator to a position where it does not interfere with the movement of the printhead opposite the housing 204. The flushing fluid prevents ink from drying at the nozzles and on the faceplate. Additionally, the flushing fluid dissolves dried ink at the nozzles and on the faceplate, which aids in restoring clogged or inoperative inkjets to their operational condition. The applicator 290 can be a roller having an internal supply of flushing fluid that seeps to the outer surface of the roller, a roller suspended in a receptacle of flushing fluid so the roller can absorb the flushing fluid, or a sprayer that produces a mist of flushing fluid that falls onto the surface 232.

Figure 3:
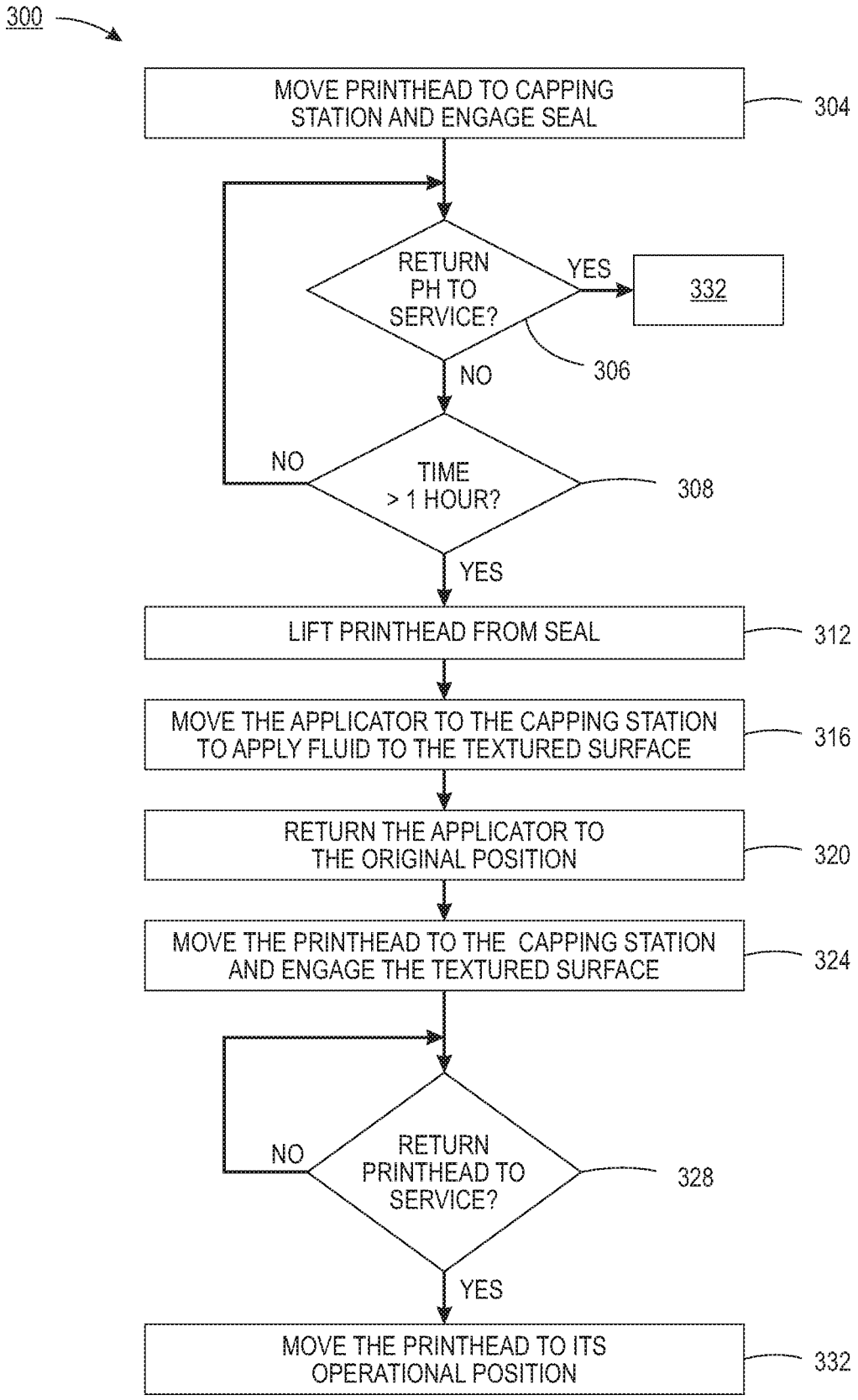
FIG. 3 is a flow diagram of a process for capping a printhead in the printer of FIG. 1A and FIG. 1B to preserve the operational status of the inkjets in the printheads of the printers.

FIG. 3 depicts a flow diagram for a process 300 that operates the capping system 60' to cover the faceplate of the printhead with a film to preserve the viscosity of the ink in the nozzles at the low viscosity. In the discussion below, a reference to the process 300 performing a function or action refers to the operation of a controller, such as controller 80', to execute stored program instructions to perform the function or action in association with other components in the printer. The process 300 is described as being performed in the printer 10 of FIG. 1A and FIG. 1B for illustrative purposes.

The process 300 of operating the printer 10 is now discussed with reference to FIG. 3 and the illustrations of FIG. 1B, FIG. 2A, and FIG. 2B. When a printhead is finished printing, it is moved to a capping station 60' to engage the seal (block 304). A timer is initiated and monitored to determine whether the duration of a temporary period has expired (block 308). In the process of FIG. 3, the temporary inactivity period is one hour, although other periods of time can be used for the temporary period, provided they are not so long that the ink begins to change viscosity at the nozzles. As long as the temporary period is active, the printhead remains in contact with the seal at the first position shown in FIG. 2A. If the inactivity period extends beyond the temporary period, such as over an hour, the controller 80' operates one or more actuators to lift the printhead from the seal (block 312) and then move the flushing fluid applicator 290 into engagement with the surface 232 of the plate 212 to apply flushing fluid to the surface (block 316). After the application is complete, the applicator 290 is then returned to its original position (block 320). The controller 80' then operates an actuator 40 to return the printhead to the capping station 60' and pushes the faceplate of the printhead into the volume within the housing 204 the predetermined distance so the surface 232 of the plate 212 engages the faceplate of the printhead (block 324). The controller monitors a signal from the user interface 50 that indicates when the printhead is to be returned to operational status (block 328). When the signal is detected, the controller 80' operates the actuator 40 to return the printhead to its position in the printer for operational service (block 332). Before the printhead is returned to operational status, the process can also determine whether the inkjet nozzles in the printhead need priming to remove flushing fluid from the faceplate of the printhead, and, if they do, perform the priming of the nozzles in a known manner.

It will be appreciated that variants of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A capping station for storing printheads during periods of printhead inactivity comprising:

a housing having at least one wall and a floor configured to enclose a volume partially;

a plate having a textured surface that is positioned at a predetermined distance from a top surface of the at least one wall of the housing, the textured surface being made of a resilient material and having cells for containment of flushing fluid, the textured surface has a length and a width, the length and the width of the textured surface forming an area that is greater than an area of a faceplate of a printhead to be stored in the volume of the housing;

at least a pair of members extending from a side of the plate opposite the textured surface, the members extending through a pair of openings in the floor of the housing so the members reciprocate within the openings of the floor; and a pair of biasing members mounted between the surface of the plate from which the members extend and the floor of the housing.

2. The capping station of claim 1 wherein the textured surface has regularly formed cells.

3. The capping station of claim 2 wherein the regularly formed cells are hexagonal.

4. The capping station of claim 1 wherein the biasing members are springs mounted about the members extending from the plate.

5. The capping station of claim 4, the housing further comprising:

a sealing member mounted to an upper surface of the at least one wall of the receptacle so the sealing member surrounds a perimeter of a printhead faceplate when the printhead is inserted into the volume of the housing.

6. The capping station of claim 5 wherein the sealing member is comprised essentially of an elastomeric material.

7. A capping station for storing printheads during periods of printhead inactivity comprising:

a housing having at least one wall and a floor configured to enclose a volume partially;

a plate having a textured surface that is positioned at a predetermined distance from a top surface of the at least one wall of the housing, the textured surface being made of a resilient material and having cells for containment of flushing fluid, the textured surface has a length and a width, the length and the width of the textured surface forming an area that is greater than an area of a faceplate of a printhead to be stored in the volume of the housing;

an applicator; and an actuator operatively connected to the applicator and configured to move the applicator from a first position outside the volume of the housing to a second position within the housing to apply flushing fluid to the textured surface of the plate.

8. A printer comprising:

a plurality of printheads; and a capping station for each printhead in the plurality of printheads, each capping station including:

a housing having at least one wall and a floor configured to enclose a volume partially;

a plate having a textured surface that is positioned at a predetermined distance from a top surface of the at least one wall of the housing, the textured surface being made of a resilient material and having cells for containment of flushing fluid and the textured surface having a length and a width that form an area that is greater than an area of a faceplate of a printhead to be stored in the volume of the housing;

at least a pair of members extending from a side of the plate opposite the textured surface, the members extending through a pair of openings in the floor of the housing so the members reciprocate within the openings of the floor; and a pair of biasing members mounted between the surface of the plate from which the members extend and the floor of the housing.

9. The printer of claim 8 wherein the textured surface has regularly formed cells.

10. The printer of claim 9 wherein the regularly formed cells are hexagonal.

11. The printer of claim 8 wherein the biasing members are springs mounted about the members extending from the plate.

12. The printer of claim 11, the housing further comprising:

a sealing member mounted to an upper surface of the at least one wall of the receptacle so the sealing member surrounds a perimeter of a printhead faceplate when the printhead is inserted into the volume of the housing.

13. The printer of claim 12 wherein the sealing member is comprised essentially of an elastomeric material.

14. A printer comprising:

a plurality of printheads; and a capping station for each printhead in the plurality of printheads, each capping station including:

a housing having at least one wall and a floor configured to enclose a volume partially;

a plate having a textured surface that is positioned at a predetermined distance from a top surface of the at least one wall of the housing, the textured surface being made of a resilient material and having cells for containment of flushing fluid and the textured surface having a length and a width that form an area that is greater than an area of a faceplate of a printhead to be stored in the volume of the housing an applicator; and an actuator operatively connected to the applicator and configured to move the applicator from a first position outside the volume of the housing to a second position within the housing to apply flushing fluid to the textured surface of the plate.

* * * * *